United States Patent [19]

Hammond et al.

[11] 4,254,594

[45] Mar. 10, 1981

[54] COMBINATION DRIP EDGE MEMBER AND RAKE

[76] Inventors: Karl Hammond, 3214 Brownell Blvd.; Earl Hammond, 3064 West Dartmouth, both of Flint, Mich. 48504

[21] Appl. No.: 919,789

[22] Filed: Jun. 28, 1978

Related U.S. Application Data

[63] Continuation-in-part of Ser. No. 772,524, Feb. 28, 1977, abandoned.

[51] Int. Cl.[3] ..... E04D 13/04; E04D 13/15

[52] U.S. Cl. ..... 52/11; 52/94

[58] Field of Search ..... 52/11, 94, 95

[56] References Cited

U.S. PATENT DOCUMENTS

| | | | |
|---|---|---|---|
| 1,336,118 | 4/1920 | Wright | 52/94 |
| 2,943,421 | 7/1960 | Squires | 52/11 |
| 3,188,772 | 6/1965 | Tennison, Jr. | 52/95 |
| 3,242,622 | 3/1966 | Snead | 52/94 |
| 3,344,561 | 10/1967 | Anderson | 52/11 |
| 3,436,877 | 4/1969 | Gunning | 52/94 X |

FOREIGN PATENT DOCUMENTS

| | | | |
|---|---|---|---|
| 980520 | 1/1965 | United Kingdom | 52/94 |

*Primary Examiner*—Alfred C. Perham

*Attorney, Agent, or Firm*—Grifford, Van Ophem, Sheridan & Sprinkle

[57] ABSTRACT

A combination drip edge member and rake is provided for use in conjunction with a building construction having a roof for protecting the roof edge from water and a backup damage. The combination comprises a first portion which flatly abuts against the roof and extends outwardly so that the outer edge of the first portion is spaced from and substantially parallel to the edge of the roof. A second portion of the combination extends adjacent to and underneath the first portion between the outer edge of the first portion and terminates closely adjacent the roof edge while a third portion engages the roof edge and extends substantially vertically downwardly from the inner edge of the second portion. A fourth portion of the combination extends substantially horizontally inwardly from the lower depending edge of the third portion and terminates substantially at the sidewalls of the building construction. The first, second, third and fourth portions of the combination are integrally constructed, preferably from sheet metal, vinyl or the like.

7 Claims, 3 Drawing Figures

COMBINATION DRIP EDGE MEMBER AND RAKE

CROSS REFERENCES TO RELATED APPLICATIONS

The present application is a continuation-in-part of Ser. No. 772,524, COMBINATION DRIP EDGE MEMBER AND RAKE, filed Feb. 28, 1977, and now abandoned.

BACKGROUND OF THE INVENTION

I. Field of the Invention

The present invention relates generally to roof edge constructions and, more particularly, to a combination drip edge member and rake which is integrally constructed.

II. Description of the Prior Art

Many building constructions comprise a plurality of vertical walls which are covered at their top by a roof. The roof typically slants downwardly and, in turn, is covered with a plurality of overlapping shingles. The combination of the sloping roof and the overlapping shingles, of course, forces water to flow downwardly along the roof and over its edge.

Typically, a facia board is secured for support to the building construction underneath the roof and against the adjacent vertical wall. In addition, a narrow facia strip is secured against the facia board and underneath the roof. The facia strip both maintains a finished appearance for the building construction and protects the facia board, roof and vertical wall junction against damage from the weather and particularly from water damage. A gutter or trough is also usually disposed along and below the edge of the roof in order to channel water falling from the roof edge away from the building construction.

This previously known building construction, however, has proved disadvantageous in that water oftentimes washes underneath the shingles and damages the roof. Similarly, ice oftentimes builds up and forces its way underneath the roof thus damaging it. In order to minimize such water damage it is often necessary to attach a flat elongated drip edge member between the roof and the shingles so that the outer edge of the drip edge member is spaced outwardly from and is substantially parallel to the roof edge. By use of these previously known drip edge members, the edge of the roof is effectively extended outwardly to minimize the backwashing of water underneath the shingles and also to eliminate ice buildup.

A still further disadvantage of the previously known roof constructions is that water often seeps behind the facia strip which rots and deteriorates not only the facia strip but also the roof and the vertical walls of the buildings. In order to protect the building construction against this latter type of water damage, a device commonly known as a rake, is provided around and protects the facia strip. More specifically, the rake typically includes a portion which extends between the roof and shingles, a second portion which extends downwardly over the facia strip and a third member which extends inwardly underneath the bottom end of the facia strip. The rake thus covers and protects the facia strip. Rakes have also been used to cover the old roof when reroofing an existing roof. The rakes thus protect the roof structure and also desirably give a new edge look.

It has been the previous practice to secure both a drip edge member and a rake along the edge of the roof in order to protect both the roof, facia board, and the facia strip from water damage. This previous construction, of course, necessitates overlapping portions of the drip edge member and the rake between the roof and the shingles which results in metal wastage and, therefore, increases building costs. Moreover, the attachment of both a drip edge member and a rake along the roof edge is awkward and time consuming in practice which accordingly results in increased labor costs.

SUMMARY OF THE PRESENT INVENTION

The present invention overcomes the aforementioned disadvantages of the previously known drip edge members and rakes by providing a combination drip edge member and rake which is integrally constructed for both simple and effective attachment to a building construction.

In brief, the device of the present invention comprises a first portion interposed between the roof of the building construction and the shingles which extends outwardly from the edge of the roof so that the outer edge of the first portion is spaced from and substantially parallel to the edge of the roof. A second portion of the device of the present invention extends from the outer edge and underneath the first portion toward and terminates closely adjacent the edge of the roof so that the second portion is substantially parallel and adjacent to the first portion. A third portion of the device of the present invention engages the roof edge and extends generally vertically downwardly from the inner edge of the second portion while a fourth portion extends substantially horizontally inwardly from the lower depending edge of the third portion toward the building construction. The first, second, third and fourth portions of the device of the present invention are integrally constructed, preferably from sheet metal such as aluminum or the like.

The width of the second portion, and thus, the outward extension of the device of the present invention from the roof edge, is less than the width of a conventional rain gutter attached to the building construction and underneath the roof edge. Thus, rain water flowing across the outer edge of the first portion is received within the gutter without rearrangement, alteration or repositioning of the gutter.

The combination drip edge member and rake of the present application achieves several advantages over the previously known drip edge members and previously known rakes. One such advantage is that since the device of the present invention is integrally constructed, attachment of the device of the present invention to a building construction is less awkward and, thus, more rapid than the previously known drip edge member and rakes. This, in general, reduces the overall labor costs necessary to construct the building construction.

A still further advantage of the device of the present invention is that the facia strip in the building construction can be enclosed by the device of the present invention. By enclosing the facia strip, water damage to the facia strip is effectively prevented.

A still further advantage of the device of the present invention is that in new building construction, the facia strip can be entirely omitted from the building construction. This is permissible since the third and fourth portions of the device of the present invention protect the junction of the roof and the vertical wall of the building construction from water damage while simultaneously providing a finished look for the building construction. The elimination of the facia strip, of course, saves both material and labor costs.

Yet a still further advantage of the present invention is that the first portion of the device can be positioned between an old roof and a new roof when the new roof is attached over the old roof. This provides a neat exterior appearance rather than the previously known bulky, two layer appearance without the drip edge member.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF THE PRESENT INVENTION

Figure 1:
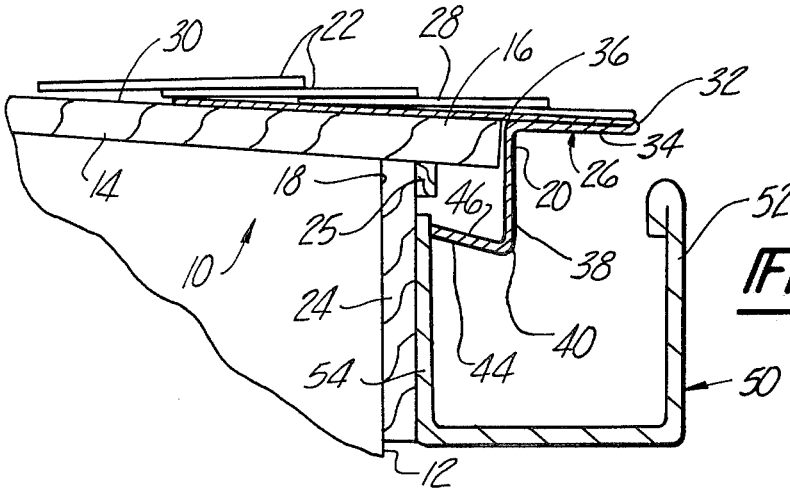
FIG. 1 is a fragmentary cross-sectional view showing the device of the present invention installed upon a building construction.

With reference first to FIG. 1, a building construction 10 such as, for example, a home, office building, or the like, is thereshown and includes a plurality of vertical walls 12 (only one of which is shown) and a roof 14 attached across the upper end of the walls 12. Typically, the roof 14 includes an overhanging portion 16 which extends outwardly from the edge 18 of the vertical wall 12 so that the outer edge 20 of the roof portion 16 is spaced from and substantially parallel to the wall edge 18. Also shown in FIG. 1, the roof 14 slopes downwardly and is covered by overlapping shingles 22 so that water falling on the roof 14 runs downwardly towards the outer edge 20 of the roof portion 16.

An elongated facia board 24 is typically secured underneath and supports the overhanging portion 16 of the roof 14 and against the vertical wall 12 so that the facia board 24 covers the junction of the vertical wall 12 with the roof 14. In addition a narrow facia strip 25 is secured underneath the roof overhanging portion 16 and against the facia board 24 and provides a finished appearance for the building construction.

A rain gutter 50, which is generally U-shaped in cross section is attached by means to the facia board 24 underneath the roof edge 20 and generally parallel thereto. The gutter 50 extends outwardly from the roof edge 20 a predetermined distance to catch water flowing thereacross in the well known manner.

Figure 2:
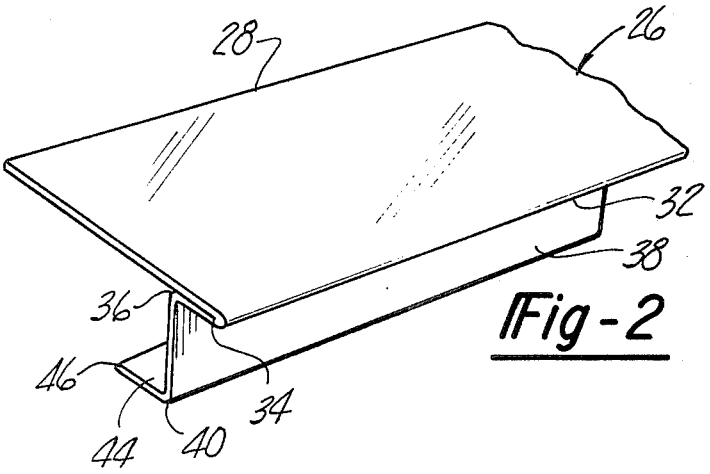
FIG. 2 is a fragmentary perspective view showing the device of the present invention.

With reference now to FIGS. 1 and 2, the combination drip edge member and rake 26 of the present invention is thereshown and is integrally constructed, preferably from sheet metal, such as aluminum, steel or the like, or vinyl, as will hereinafter be more fully described. The device 26 includes a first portion 28 which flatly abuts against the upper surface 30 of the roof 14 and underneath at least one of the shingles 22. The device 26 is positioned on the roof 14 so that the outwardly extending edge 32 of the first portion 28 is spaced from and substantially parallel to the outer edge 20 of the overhanging roof portion 16. In addition, as shown in FIG. 1, the shingles 22 preferably extend beyond the roof edge 20 and over the upper surface of the first portion 28. The outer edge 32 of the first portion 28, however, terminates short of the outer leg 52 of the rain gutter 50.

A second portion 34 of the device 26 extends from the outwardly extending edge 32 of the first portion 28 inwardly toward the edge 20 of the roof portion 16. The second portion 34 of the device 26 is substantially parallel to and preferably abutting the bottom surface of at least a portion of the first portion 28. The inner edge 36 of the second portion 34 terminates at or shortly before the roof edge 20.

A third portion 38 of the device 26 engages the roof edge 20 and extends substantially vertically downwardly from the inner edge 36 of the device second portion 34 so that the lower edge 40 of the third portion 38 is below the bottom surface of the facia strip 25.

A fourth and final portion 44 of the device 26 of the present invention extends from the bottom edge 40 of the third portion 38 and inwardly toward the vertical wall 12 of the building construction 10. The fourth portion 44 is parallel to the first portion 28 and is positioned underneath the facia strip 25 while the inner edge 46 of the fourth portion 44 terminates substantially at the inner leg 54 of the rain gutter 50 or, in the absence of a gutter 50, at the facia board 24. In this fashion, the facia strip 25 is entirely enclosed by the third portion 38 and fourth portion 44 of the device 26 of the present invention. Alternatively and in the absence of a rain gutter 50, the third portion 38 of the device 26 can be extended downwardly so that the facia board 24 is also enclosed by the third and fourth portions 38 and 44 of the device 26.

As has been previously mentioned, the device 26 of the present invention is preferably stamped from sheet metal or extruded from vinyl and can be constructed in any desired longitudinal length. Additionally, the edges of each of the portions 28, 34, 38 and 44 are preferably parallel with each other so that the sheet from which the device 26 is constructed is substantially rectangular in shape.

With the device 26 of the present invention installed upon a building construction 10 in the manner described above and illustrated in FIG. 1, the device 26 effectively protects both the roof and the facia strip 25 from both weather and water damage. In addition, the shingles 22 typically heat seal to the upper surface of the first portion 28 of the device 26. Thus, due to the integral construction of the device 26, all water is effectively bypassed around the facia strip 25 and to the outer face of the facia board 24 or, alternatively, the vertical wall 12 of the building construction 10.

Figure 3:
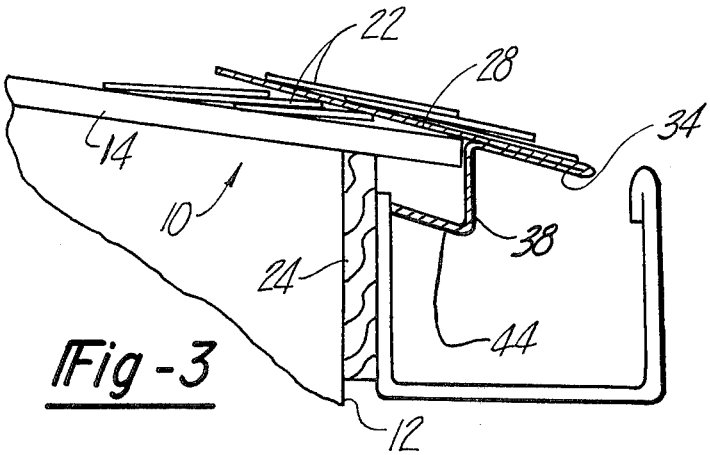
FIG. 3 is a fragmentary sectional view similar to FIG. 1, but illustrating a modification thereof.

A modified building construction utilizing the device 26 of the present invention is illustrated in FIG. 3 which differs from the construction illustrated in FIG. 1 in that the facia strip 25 (FIG. 1) is eliminated from the building construction 10. This would occur only when the device 10 of the present invention is initially installed on a new building construction. The elimination of the facia strip 25 is possible with the device 10 of the present invention since the device 26 effectively protects the junction of the roof 14 and vertical walls 12 from water damage and the like, thereby eliminating the necessity of the facia strip 25. Moreover, the device 26 of the present invention provides a "finished" appearance for the building construction 14.

The building construction in FIG. 3 also differs from FIG. 1 in that it shows new shingles 22 laid on top of old shingles 22. In this event, the device first portion 28 is positioned between the old and new shingles, thus eliminating the previously known multilayered, unsightly roof appearance.

It can thus be seen that the integrally constructed combination drip edge member and rake of the present invention is of simple and inexpensive construction and yet achieves many advantages over the previously known devices of its type. A further prime advantage of the device 26 of the present invention is that the device 26 can be simply, easily and rapidly secured to a building construction 10, thus, minimizing the labor costs over the previously known devices. Moreover, by eliminating the previously known overlapping sections of the rake and drip edge member between the roof 14 and shingles 22, the previously known material wastage is totally eliminated.

In addition, since the outermost edge 32 of the first portion 28 terminates short of the outer leg 52 of the rain gutter 50, repositioning and/or reinstallation of the rain gutter is not required.

Having thus described our invention, many modifications thereto will become apparent to those skilled in the art to which it pertains without deviation from the spirit of the invention as defined by the scope of the appended claim.

We claim:

1. In combination with a building construction having a roof with an outwardly extending edge and a facia board underneath and adjacent the roof, a device comprising:

a first portion adapted to flatly abut against the roof and having an extending portion which extends beyond and substantially parallel to the edge of the roof;

a second portion adjacent and substantially parallel to and underneath the first portion and extending from said extending portion of the first portion toward the edge of the roof said second portion having an inner edge disposed closely adjacent said roof;

a third portion engaging the edge of said roof and having a lower depending edge extending substantially vertically downwardly from the inner edge of the second portion;

a fourth portion extending from the lower depending edge of the third portion toward said building construction, said fourth portion being substantially parallel to said first portion and terminating substantially at the facia board; and wherein said first, second, third and fourth portions are integrally constructed.

2. The combination as defined in claim 1 wherein the device is constructed of sheet metal.

3. The combination as defined in claim 1 wherein the device is constructed of vinyl.

4. The combination as defined in claim 1 wherein the building construction includes a facia strip along the junction of the roof with the building construction and wherein said third and fourth portions of said device enclose said facia strip.

5. The combination as defined in claim 1 and including a plurality of shingles covering at least a portion of the first portion of the device of the present invention.

6. The combination as defined in claim 1 wherein said building construction includes a rain gutter secured thereto and underneath said edge of said roof said gutter having an outer and substantially vertically extending leg and wherein the extending portion of said first portion terminates short of the outer leg of the gutter.

7. The combination as defined in claim 6 wherein said gutter includes an inner and substantially vertically extending leg which abuts against said building construction and wherein said fourth portion terminates at said inner leg of said rain gutter.

* * * * *